United States Patent [19]

Barricks

[11] 4,103,626

[45] Aug. 1, 1978

[54] TABLE WITH FOLDABLE LEGS

[76] Inventor: Arthur G. Barricks, 7605 Vincennes Ave., Chicago, Ill. 60620

[21] Appl. No.: 848,879

[22] Filed: Nov. 7, 1977

[51] Int. Cl.[2] ..... A47B 3/00

[52] U.S. Cl. ..... 108/127; 108/160

[58] Field of Search ..... 108/127, 125, 115, 160, 108/126; 248/188.6; 297/159

[56] References Cited

U.S. PATENT DOCUMENTS

| | | | |
|---|---|---|---|
| 1,215,479 | 2/1917 | Burrowes | 108/127 |
| 1,763,671 | 6/1930 | Rastetter | 108/127 |
| 1,901,887 | 3/1933 | Allerding | 108/160 |
| 1,995,260 | 3/1935 | Flint | 248/188.6 |
| 2,660,497 | 11/1953 | Norquist | 108/127 |
| 3,072,451 | 1/1963 | Greenberg | 108/160 |
| 3,818,844 | 6/1974 | Burr | 248/188.6 |

FOREIGN PATENT DOCUMENTS

| | | | |
|---|---|---|---|
| 874,946 | 8/1961 | United Kingdom | 108/127 |

*Primary Examiner*—James T. McCall
*Attorney, Agent, or Firm*—Rudolph L. Lowell

[57] ABSTRACT

A table having two pairs of legs foldable into positions parallel with the table top, with the legs of each pair in a parallel relation. Each table leg has an associated pivot shaft journaled by a pair of brackets to a bracket plate fastened on the underside of the table. Opposite end portions of each pair of associated legs are fixed to associated pivot shafts for independent movement between an unfolded position and a folded position, wherein one of the pairs of legs lies adjacent the table underside and the other pair of legs lies normal to and in a plane parallel to such one pair.

5 Claims, 6 Drawing Figures

TABLE WITH FOLDABLE LEGS

BACKGROUND OF THE INVENTION

1. Field of the Invention

The present invention relates in general to tables having foldable legs, and more specifically to such tables having two pairs of foldable legs, with one of the pairs of legs overlying the other pair when both pairs of legs are folded.

2. Description of the Prior Art

A wide variety of table constructions with foldable legs are known in the art. Certain of these known table constructions have pairs of foldable legs that are in an overlying relation when folded, as exemplified by U.S. Pats. to Moore, No. 2,255,938 and Allerding, No. 1,901,887. In constructing such tables, special consideration must be given to the manner in which the legs will lie when folded because they cannot both lie in a common plane adjacent the underside of the table.

The Moore patent does not discuss how the legs of the table disclosed therein are arranged to lie in a folded overlying relation. However, Allerding teaches that to provide a table with pairs of overlying foldable legs that lie parallel to the table top, the legs of one pair must be attached to the table in a location with respect to the table top different from that of the other pair of legs. Allerding accomplishes such attachment by the use of pivot pins that are journaled to the side corners of the table, with the pivot pins for one pair of legs positioned further away from the table underside than the pins for the other pair of legs.

Although the Allerding construction achieves the goal of permitting both pairs of legs to lie parallel to the table top in a folded condition, side mounting of the pivot pins does not provide as durable or rigid a construction as mounting of the legs to the underside of the table.

SUMMARY OF THE INVENTION

The present invention provides a table having two pairs of foldable legs with each leg mounted to the underside of the table by means including a pivot shaft. Opposite end portions of each pair of associated legs are fixed to associated pivot shafts such that the longitudinal axes of a first pair of the legs lie in the same plane as the longitudinal axes of associated pivot shafts when folded, and the longitudinal axes of the second pair of legs are offset from the plane of the longitudinal axes of the pivot shafts when folded, so as to lie over and against the first pair of legs.

In a preferred embodiment, each leg mounting means includes a bracket plate secured directly to the underside of the table by screws, and a pair of journals or tubular members are fixed to each bracket plate to serve as a bearing means for a leg pivot shaft. A brace member extended between and connected to each pivot shaft and associated leg supports the legs in an unfolded condition by retarding movement of the legs in a direction generally parallel to the longitudinal axes of the pivot shafts. A foldable brace is also attached to each leg for retarding movement of the legs in a direction generally transverse to the longitudinal axes of the pivot shafts.

DESCRIPTION OF PREFERRED EMBODIMENT

Figure 1:
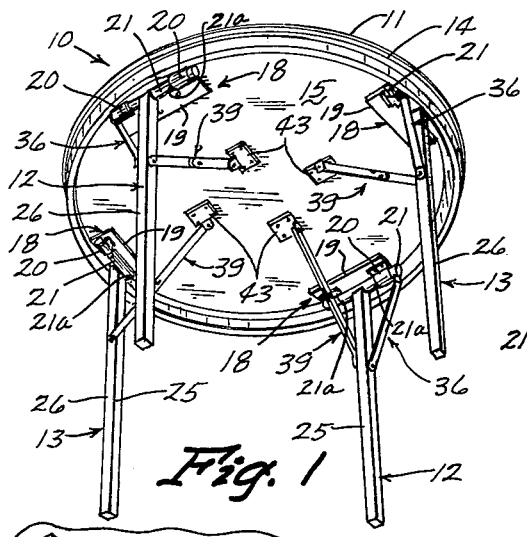
FIG. 1 is a bottom perspective view of the table of the present invention having two pairs of legs shown in an unfolded condition.

A preferred embodiment of the table of the present invention is shown in FIG. 1 at 10 and includes a table top 11 and two pairs of foldable legs 12 and 13 which are readily movable into a folded position parallel to the table top 11 for storage or transport of the table.

The table top 11 has a circular shape, but this is merely for the purpose of illustration, as the top may be of a wide variety of other shapes. A skirt 14 protrudes downwardly from the circumferential edge of the underside 15 of the top 11 to form a circular side wall for the table. Each of the legs 12 and 13 is preferably formed of metal and is of square shape in transverse cross section.

The legs 12 and 13 are each fastened to the table underside 15 by a mounting means 18 that includes a mounting plate 19, and a pair of spaced apart, U-shaped brackets or journal members 20 for a pivot shaft 21. Each mounting plate 19 is secured to the table underside 15 as by screws, and each pair of the journal members 20 is bolted to the corners along one side of the mounting plates 19.

Each pair of the journal members 20 serves as a means for supporting one of the pivot shafts 21 to provide a rotatable mount for the legs 12 and 13. The shafts 21 include nibs 21*a* adjacent the inner sides of the journal members 20 to positively prevent their axial movement. Such limit of movement can also be achieved by securement of the shafts 21 in the journal members 20 sufficiently tight to aid in preventing their axial movement but still permitting their rotation. The pivot shafts 21 preferably have a diameter substantially equal to the transverse dimension of the legs 12, 13 for a purpose to be described below.

Figure 2:
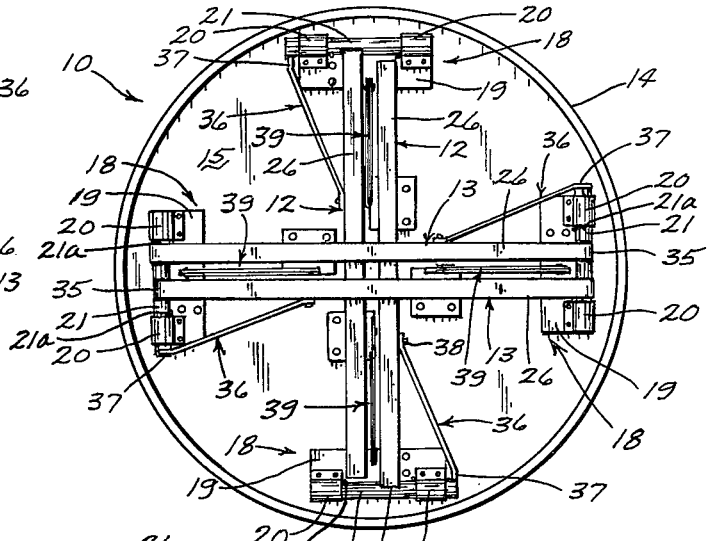
FIG. 2 is a bottom plan view of the table of FIG. 1 with the pairs of legs thereof shown in a folded condition.

The mounting plates 19 are disposed near the periphery of the table underside 15 on centerlines spaced 90° apart from one another so as to be disposed in diametrically opposite pairs. In this way, when either pair of legs 12 or 13 is folded, the legs thereof will be parallel to each other, and, as shown in FIG. 2, when both pairs of legs 12 and 13 are folded, they lie in an orthogonal or normal relation to one another, with the legs 12 adjacent the table underside 15.

Figure 3:
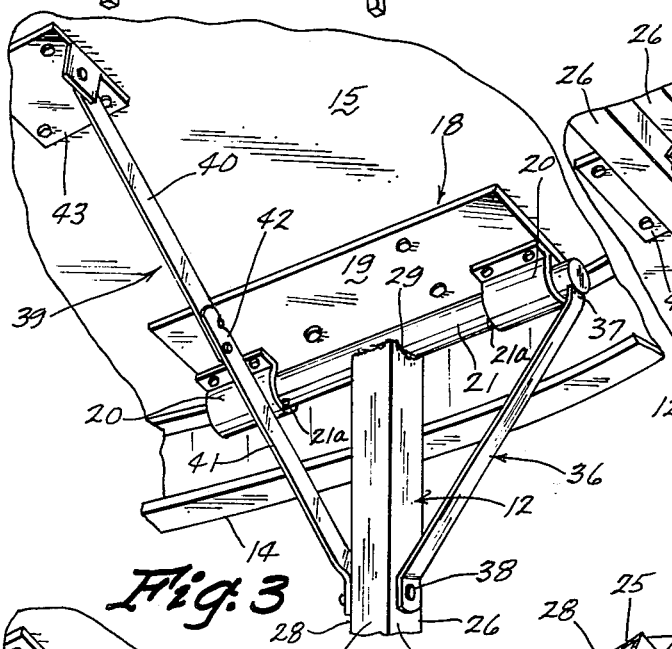
FIG. 3 is an enlarged detail perspective view of the assembly of one leg of one of said pairs of legs to the underside of the table top with the leg shown in an unfolded position.
Figure 4:
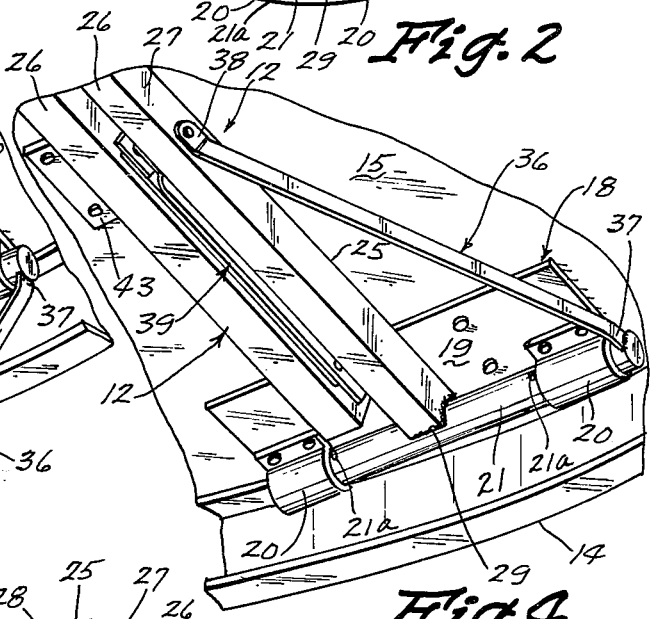
FIG. 4 is a view similar to FIG. 3 but with the leg shown in a folded position.

Referring now to FIG. 3, the legs 12 each include elongate opposite side surfaces 25 and 26 respectively, and 27 and 28 also respectively, and an end surface 29 adjacent the table underside 15. The end surface 29 of each leg 12 is of a concave shape to conform to the circumference of the associated pivot shaft 21 to which it is secured preferably by welding at a position intermediate the journal members 20. Thus, when the legs 12 are pivoted into a folded condition, their side surfaces 25 abut the table underside 15 (FIG. 4) and the longitudinal axes of the legs 12 lie in the same plane as the longitudinal axes of the pivot shafts 21.

Figure 5:
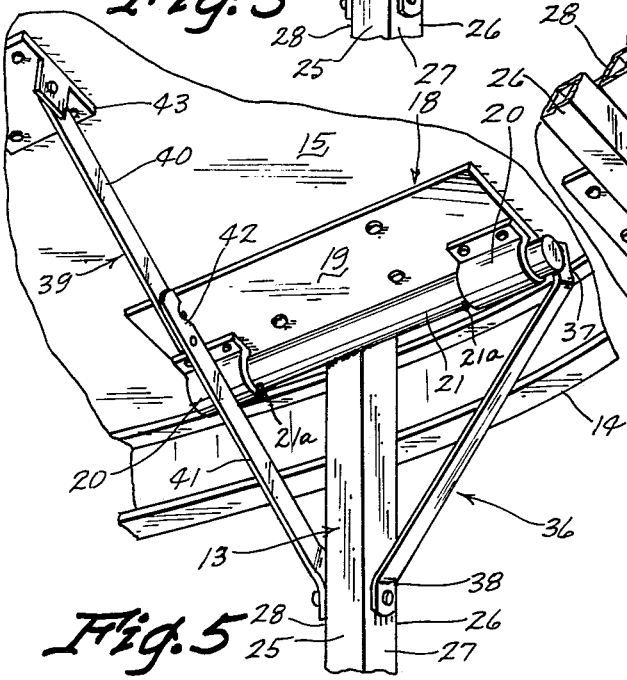
FIG. 5 is an enlarged detail perspective view of the assembly of leg of the second one of said pairs of legs to the table underside with the leg shown in an unfolded position.
Figure 6:
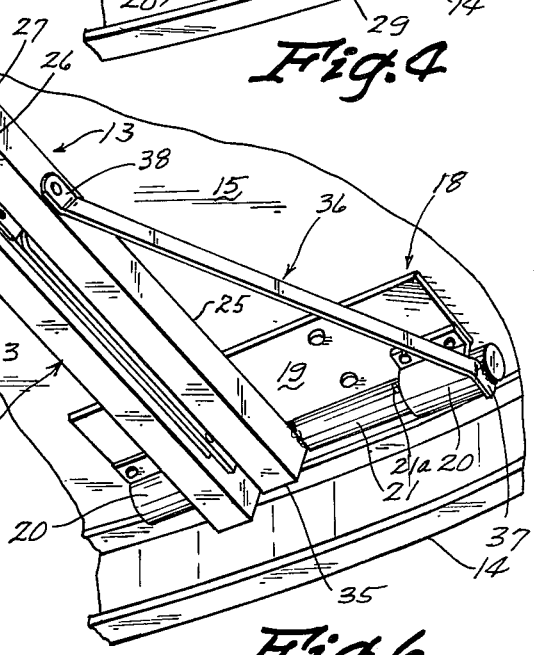
FIG. 6 is a view similar to FIG. 5 but with the leg shown in a folded position.

Referring now to FIGS. 5 and 6, the legs 13 have opposite surfaces 25 and 26 respectively, and 27 and 28, also respectively, similar to the legs 12, but differ from the legs 12 in that each has a flat end surface 35 (FIG. 6) adjacent the table underside 15. In contrast to the mounting of the legs 12 at their end surfaces 29 to the pivot shafts 21 the legs 13 are mounted to the shafts 31 at the upper end of their surfaces 25. As a result, when the legs 13 are pivoted to a folded condition (FIG. 6) in a plane parallel with the table top 11, their surfaces 25 are spaced from the table underside 15 by a distance equal to the diameter of the pivot shafts 21. The longitudinal axes of the legs 13 thus lie in a plane laterally offset from the plane of the longitudinal axes of the shafts 21 a distance equal to the radius of a shaft 21. Because the diameter of the shafts 21 is of substantially the same dimension as the dimension of the legs 12 and 13 in a direction transversely of the shafts 21, the surfaces 25 of the legs 13 abut the surfaces 26 of the legs 12. Consequently, in a folded condition the legs 12 are supported against the table underside 15 and the legs 13 in turn are supported against the legs 12 to form a sandwich assembly.

The specific relation between the dimensions of the legs 12 and 13 and the pivot shafts 21 described above is not essential to the present invention. However, the table 10 must be of a construction whereby the legs 13 will be spaced from the table underside 14 a sufficient distance to permit sandwiching of the legs 12 between the table underside 15 and the legs 13. This can be accomplished, other than by the construction of the preferred embodiment by modifying the journal members 20 to support the pivot shafts 21 further away from the table underside 15 in order that the diameter of the pivot shafts 21 can be made less than the thickness of the legs 12 and 13 in a direction transversely of the shafts 21.

To insure that the legs 12 and 13 are rigidly supported in their unfolded positions, a brace 36 is extended between and connected to each of the legs 12 and 13, and their associated pivots 21, as shown best in FIGS. 3 and 5. The braces 36 are of a unitary construction having a straight body portion and bent ends 37 and 38 which, respectively, are welded to one end of the pivot shafts 21 and pivotally connected to the surfaces 27 of the legs 12, 13. It should be noted that it is preferable to weld the brace ends 37 for the legs 13 in a 90° offset condition with respect to the welding of the brace ends 37 for the legs 12 so that the axes of the braces 36 lie in the same plane as the axes of their respective legs.

The table 10 also includes foldable braces 39 that are of a folded construction and each comprises a pair of arms 40 and 41 pivotally interconnected at 42. The free end of each of the arms 40 is pivotally connected to a bracket 43 secured to the table underside 15, and the free end of each of the arms 41 is pivoted to the surface 28 of one of the legs 12 or 13. The brackets 43 are disposed generally radially inwardly from the surfaces 28 of their associated legs 12 or 13 so that the foldable braces 39 are located in a plane parallel to the surfaces 28 both when folded or unfolded. The arms 40 of the braces 39 each have a nib (not shown) at their pivoted ends laterally extended toward the arms 41 to provide a frictional engagement of the brace arms 40 and 41 in their unfolded positions. Also one of the arms 40 has a protrusion (not shown) that fits in a corresponding recession (not shown) in the arm 41 when the brace is unfolded to serve as a limit to leg unfolding. It is seen, therefore, that each foldable brace 39 and linear brace 36 coact with an associated leg 12 or 13 to hold a pivot shaft 21 against axial movement concurrently with rigidly supporting a leg 12 or 13 in the unfolded or extended position therefor.

Thus, the present invention provides a table 10 with foldable pairs of legs 12 and 13 that are fastened to the table by mounting means secured directly to the table underside, thereby providing a table construction that is strong and durable. The legs 12 and 13 are each rigidly held in releasable unfolded positions by the braces 36 and 39, and are supported in folded positions by the sandwiching of the legs 12 between the table underside 15 and the legs 13.

Although the invention has been described with respect to a preferred embodiment thereof it is to be understood that it is not to be so limited since changes and modifications can be made therein which are within the full intended scope of this invention as defined by the appended claims.

I claim:

1. A table having a table top and two pairs of legs foldable into planes parallel with the table top whereby one leg of each pair is parallel to the other leg of such pair, said table comprising:

(a) means having pivot shaft portions for mounting each of said legs to the underside of said table top near the periphery thereof, with opposite end portions of each pair of associated legs fixed to an associated pivot shaft portion for independent movement of the legs to folded and unfolded positions therefor, and (b) the legs of one of said pairs of legs having the longitudinal axes thereof in a plane common to the longitudinal axes of said associated pivot shaft portions when in the folded positions therefor, and the legs of the other of said pairs of the legs having the longitudinal axes thereof in a plane laterally offset from the plane of the longitudinal axes of the associated shaft portions therefor when in folded positions so as to be beneath and abut against the legs of said one pair when both pairs of legs are in the folded positions therefor.

2. A table according to claim 1 wherein:

(a) brace means extended between and connected to each of said mounting means and an associated leg to prevent movement of said leg in a direction axially of an associated pivot shaft portion.

3. A table according to claim 1 wherein said mounting means includes for each leg of said pairs of legs:

(a) a mounting plate mounted to the underside of said table top, and (b) at least one bearing bracket fixed to said mounting plate to journal one of said pivot shaft portions on said mounting plate.

4. A table according to claim 1, further comprising:

(a) a foldable brace means for each of said legs having:

(1) first and second arms pivotally interconnected at one of the ends thereof, and (2) means pivotally connecting the other end of said first arm to the underside of said table top at a location generally radially inwardly from one of said legs, and (3) said second arm having the other end thereof fixed to said one leg.

5. A table according to claim 1, wherein:

(a) each of said legs has an end surface facing the underside of the table top when a leg is in an unfolded position therefor, and an elongated side surface adjacent the underside of the table top when a leg is in a folded position therefor, and (b) each leg of one pair of said legs is mounted on an associated pivot shaft portion at said end surface thereof whereby to lie adjacent the underside of the table top in a folded position and each leg of the other pair of said legs is mounted on an associated pivot shaft portion near one end of said side surface so as to lie adjacent to and in an overlying relation with said one pair of legs when both of said pairs of legs are in the folded positions therefor.

* * * * *